United States Patent [19]

Phillips

[11] Patent Number: 4,495,244

[45] Date of Patent: Jan. 22, 1985

[54] CONTINUOUS FILAMENT SLUB YARN

[75] Inventor: Bobby M. Phillips, Kingsport, Tenn.

[73] Assignee: Eastman Kodak Company, Rochester, N.Y.

[21] Appl. No.: 553,932

[22] Filed: Nov. 21, 1983

[51] Int. Cl.[3] ..... D02G 3/00; D02G 3/02; D02G 3/36

[52] U.S. Cl. ..... 428/399; 428/400; 57/248; 57/206; 57/209

[58] Field of Search ..... 428/399, 400, 397; 57/209, 206, 248

[56] References Cited

U.S. PATENT DOCUMENTS 3,092,890 6/1963 Bromley et al. ..... 428/399
3,640,064 2/1972 Palm et al. ..... 57/209
3,695,990 10/1972 Chopra et al. ..... 428/399
3,999,366 12/1976 Heichlinger et al. ..... 428/399
4,245,001 1/1981 Phillips et al. ..... 425/400

*Primary Examiner*—George F. Lesmes
*Assistant Examiner*—Beverly Johnson
*Attorney, Agent, or Firm*—Malcolm G. Dunn; Daniel B. Reece, III

[57] ABSTRACT

Continuous filament yarn of textile utility has slubs formed at randomly spaced intervals along the length of the yarn, with each filament having a main body section extending along the length of the filament and at least one wing member extending from the main body section along such length, the wing member of the filament rising and falling in wave-like manner along the main body section only within the area of the aforementioned randomly spaced intervals.

3 Claims, 6 Drawing Figures

CONTINUOUS FILAMENT SLUB YARN

DESCRIPTION

1. Technical Field

The present invention is directed to a continuous filament yarn having slubs of random lengths formed therein at random intervals along the length of the yarn, and is especially directed to continuous filament yarn wherein the geometry of the slub provides a three dimensional (3-D) effect in the yarn for enhanced contrast in appropriately constructed fabrics.

2. Background Art

U.S. Pat. Nos. 3,219,739 and 4,245,001 each disclose filament cross-sections and spinneret orifices for spinning such filament cross-sections, some of which may be used in the practice of the present invention.

U.S. Pat. No. 4,245,001, for example, discloses yarns which comprise continuous multifilaments such as from polyester polymer, each having at least one body section and having extending therefrom along its length at least one wing member, the body section comprising about 25 to about 95% of the total mass of the filament and the wing member comprising about 5 to about 75% of the total mass of the filament, the filament being further characterized by a wing-body interaction defined by $$\left(\frac{(D\max - D\min)D\min}{2Rc^2}\right)\left(\frac{Lw}{D\min}\right)^2 \geqq 10$$

where the ratio of the width of said fiber to the wing thickness ($L_T$/Dmin) is $\leqq 30$. The patent states that the filaments of the invention may be prepared by spinning the polymer through an orifice which provides a filament cross-section having the necessary wing-body interaction and the ratio of the width of the filament to the wing thickness, as set forth above. The quenching of the fiber (as in melt spinning) must be such as to preserve the required cross-section. The thickness of the wing(s) may vary up to about twice its minimum thickness and the greater thickness may be along the free edge of the wing. The patent discusses how the measurements are made to determine wing-body interaction.

U.S. Pat. No. 3,219,739, as mentioned above, discloses filament cross-sections and spinneret orifices for spinning such cross-sections, some of which may also be used in the practice of this invention. The filaments comprise a stem and at least one fin extending from the stem and having a width at least 1.4 times its thickness. The filament is drawn from 1 to 4 times its original length but under amorphous retaining conditions, which means under conditions which induce a minimum of crystallinity. The filament as drawn may then be shrunk along its entire length from about 15 to 75% to provide a convoluted filamentary structure. The convolution may involve a sinuous conformation of the fin or spiral or helical turns of the fins about the filament stem.

U.S. Pat. No. 3,591,672 discloses a spun continuous filament synthetic yarn having variable properties along its length by applying to the spun, solidified, undrawn yarn a plasticizer for the yarn material in an amount varying along the length of the yarn to produce relatively plasticized yarn portions and thereafter drawing the yarn to an extent such that variable properties are imparted along its length. The specification of the patent states that for many synthetic polymers, such as nylon, water functions as such a plasticizer. In my invention water serves to keep the potential slub portion of the yarn below glass transition temperature during the drafting process. This insulation of the yarn yields essentially an amorphous section which ultimately becomes the slub.

The present invention stems from my discovery that feed yarns having cross-sections such as disclosed in U.S. Pat. Nos. 4,245,001 or 3,219,739 may be selectively treated along the length of the yarns in the manner disclosed herein to produce slubs of unusual definition, i.e., slubs having a three-dimensional (3-D) effect as compared to the flat effect attained from slubs prepared from round cross-sections yarns, for example. In appropriately constructed fabrics, this 3-D effect presents quite a contrast, and provides useful and desirable novelty effects in home furnishing and apparel fabrics. The yarns produced by these feed yarns, as treated in accordance with my invention, will have textile utility, which means that the yarns will have physical properties sufficient for normal textile processing into woven and knit fabrics and will be sufficiently stable to withstand normal dyeing and finishing procedures for textile fabrics. Typical properties are:

| | |
|---|---|
| tenacity | >1.0 g./d. |
| elongation | 15 → 50% |
| boiling water shrinkage | 0–12% |

DISCLOSURE OF THE INVENTION

In accordance with the present invention I provide a continuous filament yarn wherein the yarn has slubs formed at randomly spaced intervals along the length of the yarn. Each filament of the yarn has a main body section extending along the length of the filament and at least one wing member extending from the main body section along the length of the filament. The wing member rises and falls in wave-like manner along the main body section only within the area of the aforementioned randomly spaced intervals.

The length of the wave-like wing member within the area of the aforementioned randomly spaced interval varies from about 0.635 centimeter (0.25 inch) to about 15.2 centimeters (6 inches).

The intervals between the slubs may vary in a random manner with the mean interval being about 30.5 centimeters (12 inches) to about 91.4 centimeters (36 inches). The standard deviation of the interval distances may vary from about $\frac{1}{4}$ the mean interval distance to about $1\frac{1}{4}$ times the mean interval distance.

BRIEF DESCRIPTION OF THE DRAWINGS

The details of my invention will be described in connection with the accompanying drawings in which.

BEST MODE FOR CARRYING OUT THE INVENTION

Figure 1:
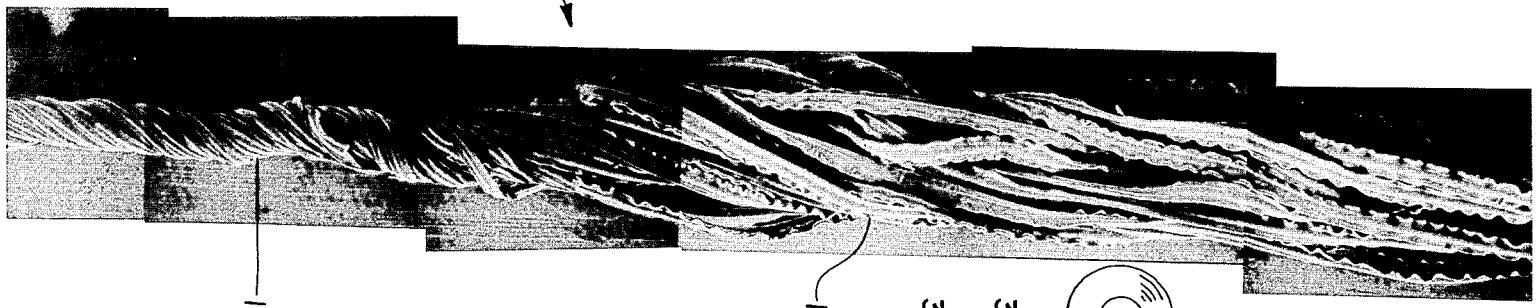
FIG. 1 is a photographic montage of a magnified length of one type of yarn made in accordance with the invention and illustrating a three-dimensional effect slub portion of the yarn length and the nonslubbed portion of the yarn length.

In reference to FIGS. 1 through 5, FIG. 1 is a photographic montage of a length of yarn 10 illustrating a typical randomly formed slub 12 in the slubbed portion of such length of yarn and a nonslubbed portion 14 of the yarn length. Although the nonslubbed portion 14 is shown to be highly twisted, this was done only to highlight the slubbed portion of the yarn length. The nonslubbed portion may be twisted or entangled.

The slubs are formed at randomly spaced intervals along the length of yarn and are of random lengths.

FIGS. 2 through 5 show photomicrographs of highly magnified individual filaments 16 in different rotational aspects about the axes of the filaments. Each filament 16 has a main body section 18 extending along the length of the filament, and a wing-member 20, which extends from the main body section 18 along the length of the filament. The wing member 20, as shown in the photomicrographs, rises and falls in wave-like manner along the main body section 18 only within the area of the randomly spaced intervals where the slub in the yarn 10 occurs.

The length of a wave-like wing member may vary from about 0.635 centimeters (0.25 inch) to about 15.2 centimeters (6 inches) only within the area of the aforementioned randomly spaced intervals along the length of the yarn for the slubbed portion of the yarn. The intervals between the slubs may vary in a random manner with the mean interval being about 30.5 centimeters (12 inches) to about 91.4 centimeters (36 inches). The standard deviation of the interval distances may vary from about $\frac{1}{4}$ the mean interval distance to about $1\frac{1}{4}$ times the mean interval distance.

The feed yarn for the slub yarn of this invention may be melt spun from polyester polymer as disclosed in U.S. Pat. No. 4,245,001, or such as the variation of synthetic linear condensation polyesters disclosed in U.S. Pat. No. 3,219,739. The feed yarn has a cross-section such as disclosed in U.S. Pat. No. 4,245,001, for example, but with a wing-body interaction $\geqq 8$. It has been found that if the wing-body interaction is less than 8 for the type of cross-sections disclosed in U.S. Pat. No. 4,245,001, then the resulting slubs are not as effective in appearance.

It has also been found that for a filament having a cross-section comprising a body section and one or more wing members with the wing members varying up to about twice their minimum thickness along their width, if at the junction of the body section and the one or more wing members the respective faired surfaces thereof should define a radius of concave curvature (Rc) on one side of the cross-section and a generally convex curve located on the other side of the cross-section generally opposite the aforementioned radius of curvature (Rc), then the wing-body interaction may be $\geqq 1$, which will also result in effective feed yarns for the practice of this invention. In these filament cross-sections of yarns, the periphery of the body section defines at least one central convex curve on one side of the cross-section and one central concave curve located on the other side of the cross-section generally opposite the aforementioned at least one central convex curve. The periphery of the body section may define on one side of the cross-section at least one central convex curve and at least one central concave curve connected together and on the other side of the cross-section at least one central concave curve and at least one central convex curve connected together. The periphery of the body section may also, for example, define on one side of the cross-section two central convex curves and a central concave curve connected therebetween and on the other side of the cross-section two central concave curves and a central convex curve connected therebetween. The one or more wing members further may each have along the periphery of their cross-section on one side of the cross-section a convex curve joined to the aforementioned radius of concave curvature (Rc) and on the other side of the cross-section a concave curve joined to the first-mentioned convex curve that is generally opposite the aforementioned radius of concave curvature (Rc). The one or more wing members still further may each have along the periphery of the cross-section on one side of the cross-section two or more curves alternating in order of convex to concave with the latter-mentioned convex curve being joined to the aforementioned radius of concave curvature (Rc) and on the other side of the cross-section two or more curves alternating in order of concave to convex with the latter-mentioned concave curve being joined to the first-mentioned convex curve opposite the aforementioned radius of curvature (Rc). Also the filament cross-section may have four wing members and a portion of the periphery of the body section may define on one side thereof at least one central concave curve and on the opposite side thereof at least one central concave curve, with each central concave curve being located generally offset from the other.

The following melt-spinning conditions for a feed yarn from a poly(ethylene terephthalate) polymer was found to be effective, although it should be understood that the invention disclosed herein is not limited to only these conditions.

The filament shown in FIGS. 1–5 was made using the following equipment and process conditions.

The basic unit of the spinning system design can be subdivided into an extrusion section, a spin block section, a quench section and a take-up section. A brief description of these sections follows.

The extrusion section of the system consists of a vertically mounted screw extruder with a 28:1 L/D screw about 6.35 centimeters ($2\frac{1}{2}$ inches) in diameter. The extruder is fed from a hopper containing polymer which has been dried in a previous separate drying operation to a moisture level $\leqq 0.003$ weight percent. Pellet poly(ethylene terephthalate) (PET) polymer (0.64 I.V.) (I.V. = inherent viscosity, which is equal to the concentration of 0.23% of the polymer in the solvent; 60% by weight phenol and 40% by weight tetrachloroethane. The polymer is dissolved at 125° C. and is measured at 25° C.) containing 0.3% $TiO_2$ and 0.9% diethylene glycol (DEG) enters the feed port of the screw where it is heated and melted as it is conveyed vertically downward. The extruder has four heating zones of about equal length which are controlled, starting at the feed end at a temperature of 280°, 285°, 285°, 280° C. These temperatures are measured by platinum resistance temperature sensors Model No. 1847-6-1 manufactured by Weed. The rotational speed of the screw is controlled to maintain a constant pressure in the melt (14479.5 kilopascals or 2100 psi) as it exits from the screw into the spin block. The pressure is measured by use of an electronic pressure transmitter [Taylor Model 1347.TF11334(158)]. The temperature at the entrance to the block is measured by a platinum resistance temperature sensor Model No. 1847-6-1 manufactured by Weed.

The spin block of the system consists of a 304 stainless steel shell containing a distribution system for conveying the polymer melt from the exit of the screw extruder to eight dual position spin packs. The stainless steel shell is filled with a Dowtherm liquid/vapor system for maintaining precise temperature control of the polymer melt at the desired spinning temperature of 280° C. The temperature of the Dowtherm liquid/vapor system is controlled by sensing the vapor temperature and using this signal to control the external Dowtherm heater. The Dowtherm liquid temperature is sensed but is not used for control purposes.

Mounted in the block above each dual postion pack are two gear pumps. These pumps meter the melt flow into the spin pack assemblies and their speed is precisely maintained by an inverter controlled drive system. The spin pack assembly consists of a flanged cylindrical stainless steel housing (198 mm. in diameter, 102 mm. high) containing two circular cavities of 78 mm. inside diameter. In the bottom of each cavity, a spinneret, as shown in FIG. 8 of U.S. Pat. No. 4,245,001, is placed followed by 300 mesh circular screen, and a breaker plate for flow distribution. Above the breaker plate is located a 300 mesh screen followed by a 20 mm. bed of sand (e.g., 20/40 to 80/100 mesh layers) for filtration. A stainless steel top with an entry port is provided for each cavity. The spin pack assemblies are bolted to the block using an aluminum gasket to obtain a no-leak seal. The pressure and temperature of the polymer melt are measured at the entrance to the pack (126 mm. above the spinneret exit). The spinneret used is that shown in FIGS. 8 and 9 of U.S. Pat. No. 4,245,001.

The quench section of the melt spinning system is described in U.S. Pat. No. 3,669,584. The quench section consists of a delayed quench zone near the spinneret separated from the main quench cabinet by a removable shutter with circular openings for passage of the yarn bundle. The delayed quench zone extends to approximately 11.45 centimeters (4.5 inches) below the spinneret. Below the shutter is a quench cabinet provided with means for applying force convected cross-flow air to the cooling and attenuating filaments. The quench cabinet is approximately 1.033 meters (40½") tall by 26.65 centimeters (10½") wide by 36.5 centimeters (14½") deep. Cross-flow air enters from the rear of the quench cabinet at a rate of 4.50 cubic meters per minute (160 SCFM). The quench air is conditioned to maintain constant temperature at 25° C.±1° C. (77°±2° F.) and humidity is held constant as measured by dew point at 17.78° C.±1° C. (64°±2° F.). The quench cabinet is open to the spinning area on the front side. To the bottom of the quench cabinet is connected a quench tube which has an expanded end near the quench cabinet but narrows to dual rectangular sections with rounded ends (each approximately 16.19 centimeters×40 centimeters (6⅜"×15¾"). The quench tube plus cabinet is 4.9 meters (16 feet) in length. Air temperatures in the quench section are plotted as a function of distance from the spinneret in FIG. 19 of U.S. Pat. No. 4,245,001.

The take-up section of the melt spinning system consists of dual ceramic kiss roll lubricant applicators, two Godet rolls and a parallel package winder (Barmag SW4). The yarn is guided from the exit of the quench tube across the lubricant rolls. The RPM of the lubricant rolls is set at 32 RPM to achieve the desired level of one percent lubricant on the as-spun yarn. The lubricant is composed of 95 weight percent UCON-50HB-5100 (ethoxylated propoxylated butyl alcohol [viscosity 5100 Saybolt sec]), 2 weight percent sodium dodecyl benzene sulfonate and 3 weight percent POE5 lauryl potassium phosphate. From the lubricant applicators the yarn passes under the bottom half of the pull-out Godet and over the top half of the second Godet, both operating at a surface speed of 3014 meters/minute and thence to the winder. The Godet rolls are 0.5 m. in circumference and their speed is inverter controlled. The drive roll of the surface-driven winder (Barmag) is set such that the yarn tension between the last Godet roll and the winder is maintained at 0.1–0.2 grams/-denier. The traverse speed of the winder is adjusted to achieve an acceptable package build. The as-spun yarn is wound on paper tubes which are 75 mm. inside diameter by 290 mm. long.

The feed yarn spun from the procedure described above may be processed in the following manner in order to obtain the random-length slubs of this invention at random intervals along the yarn. The basic process may involve the protection of sections of the yarn from experiencing the normal thermal environment in a drafting or texturing process. This can be accomplished in several ways but one very attractive way is to drop an appropriate liquid in some prescribed manner on the feed yarn before it passes through the drafting or texturing process. The liquid provides a thermal capacitance for that section of yarn whch prevents it from experiencing the normal thermal environment of the process. Water is a very useful liquid for this purpose. The length of the protected sections of yarn and spacing between the sections are important. These are controlled by prescribing the drop interval and its variability, the drop size, and the speed of the drop when it intersects the yarn. A metering system feeding a yarn guide with a hole in it such as a lubrication tip may also be used. For instance water at room temperature may be dropped on the yarn at a varied rate consistent with the random length intervals and random length slubs required for this invention. Following the water dropping, the yarn is drafted and may thereafter pass into and through a heated environment while allowing the yarn to shrink in such environment to achieve shrinkage resulting in the slubs. Preferably the yarn is overfed into the heated environment to aid the shrinkage. Alternatively, the shrinkage and hence the slubs may be formed later after the yarn has been appropriately formed in fabrics. For instance, if the fabric is allowed to shrink during dyeing, the resulting slubs will dye darker because the yarn is essentially amorphous at the time of dyeing. The contrast between the nonslubbed portion and the slubbed portion in such dyed fabrics will be more dramatic.

Figure 6:
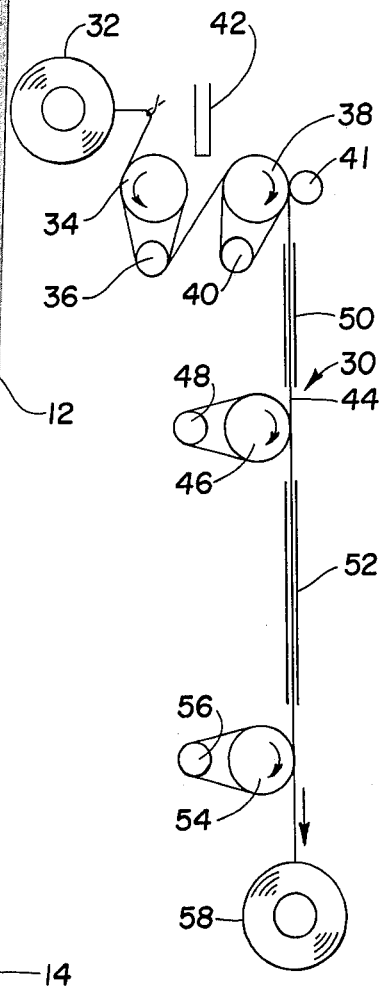
FIG. 6 is a schematic illustration of a yarn feed system for treating a feed yarn in the manner disclosed herein.
Figure 2:
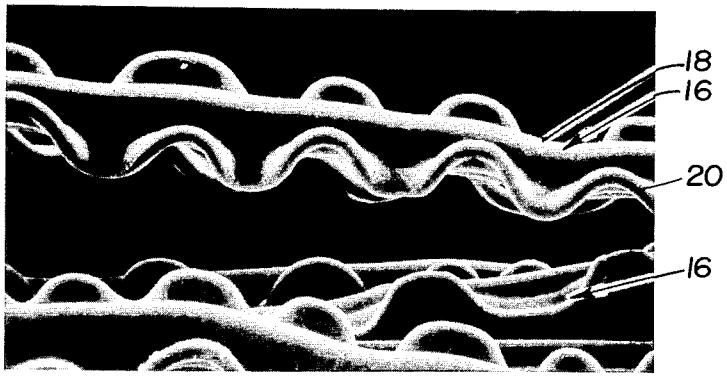
FIGS. 2, 3, 4, and 5 are photomicrographs of highly magnified individual filaments from the yarn shown in FIG. 1 and illustrating the filaments in different rotational aspects about their axes to show the appearance of the wave-like formation of the wing members in the slubbed portion of the yarn along the main body section of each of the filaments.
Figure 3:
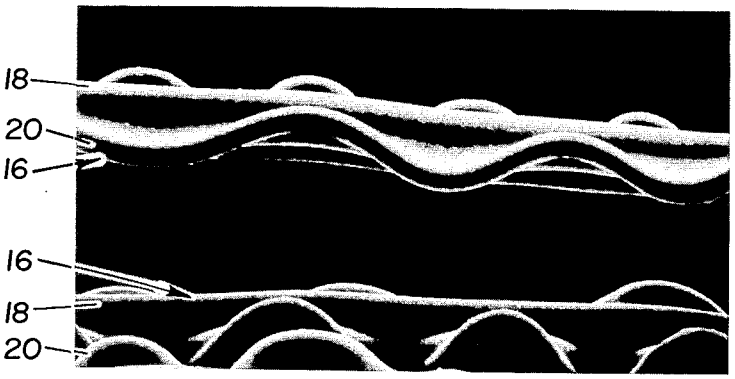
Figure 4:
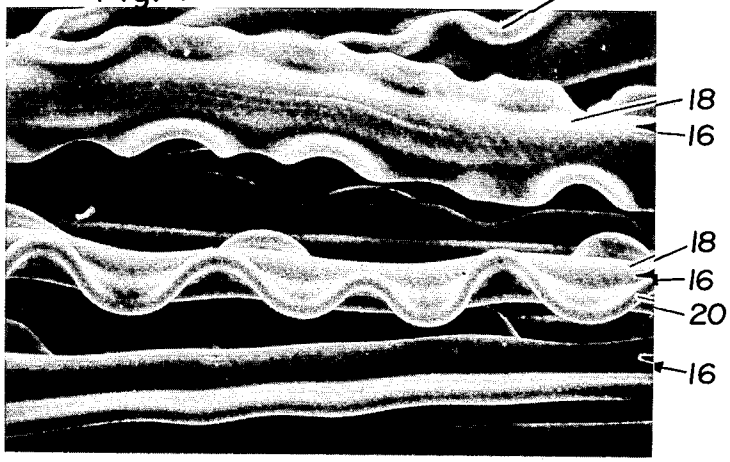
Figure 5:
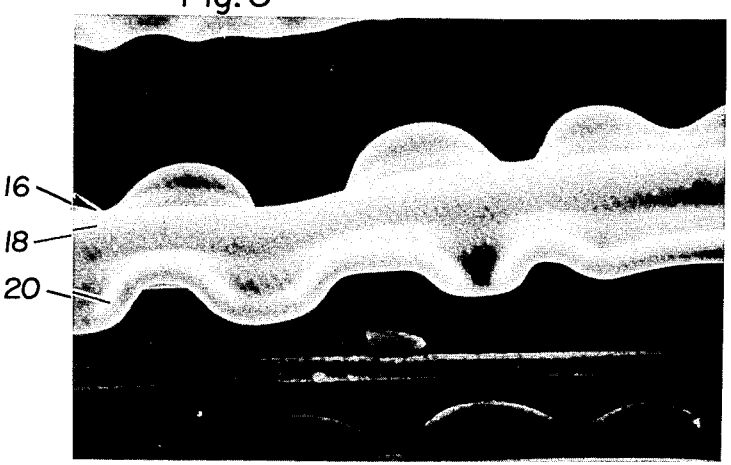

More specifically and in reference to FIG. 6, therefore, the schematic illustration shows one example of a treating arrangement that may be used to produce the yarn of the present invention. The apparatus shown at 30 in FIG. 6 may include a yarn supply 32 from which a feed yarn can be fed to a first godet roll 34 and its separator roll 36 and a second godet roll 38, which is heated, and its separator roll 40. The path between the first godet roll 36 and the second or heated godet roll 38 constitutes a pretension zone. Along this same path between these two godet rolls a liquid such as water may be dropped as from tube 42 onto the yarn 44. The yarn is then drawn and stabilized between the second or heated godet roll 38 and the third godet roll 46 and its separator roll 48, passing through a slit heater 50. A pinch roll 41 at the heated or second godet roll serves to localize the draw, as shown in U.S. Pat. No. 3,539,680. In summary up to this point, the as-spun yarn is threaded around the pretension or first godet roll 34 and then six times around the heated or second godet roll 38. The feed roll/pretension speed ratio is maintained at 1.005. From the feed or second (heated) godet roll 38, the yarn exits under the pinch roll 41 and passes through the slit heater 50 to the third godet or draw roll 46. The draw roll/feed roll speed ratio is selected based on the denier of the as-spun yarn and the desired final denier and the orientation characteristics of the as-spun yarn. The feed roll temperature was set at 83° C. However, for this yarn, 105° C. is preferred. The slit heater temperature was set at 240° C.

Following the drafting of the yarn, the yarn is then permitted to relax by overfeeding it through a heated (steam) chamber 52 and its separator roll 56, which are rotating slower than the third godet roll 46. The yarn is then taken up on a yarn package at 58.

The percent wing in the as-spun fiber cross-section is 40% and the ratio $L_T$/Dmin is 10.0. The wing-body interaction for this fiber is 15.5, calculated from 2000× photographs of the partially oriented yarn as described in U.S. Pat. No. 4,245,001.

$$\left(\frac{(78.3 - 23.3)23.3}{2(16.0)^2}\right)\left(\frac{57.2}{23.3}\right)^2 = 15.1$$

The conditions used to produce the yarn shown in FIGS. 1–5 were as follows:

| | |
|---|---|
| Draw ratio | 15 |
| Slit heater | 240° C. |
| Feed roll temp. | 83° C. |
| Draw tension | 75 grams |
| Draw roll speed | 840 m./m. |
| Forwarding godet roll speed | 800 m./m. |

The following examples more specifically illustrate the invention but it should be understood they are not intended to limit the scope of the invention.

EXAMPLE 1

The feed yarn was a two-ply 265/30 cross-section partially oriented yarn (POY) having a cross-section of a main body section and wing members disclosed in FIG. 8 of U.S. Pat. No. 4,245,001. The yarn was drawn 1.55× with a feed roll temperature of 95° C. at 800 meters per minute take-up speed. Water was dropped onto the yarn just prior to the feed roll at an average rate of 65 drops per minute in a random manner. The size of the drops was about 0.48 centimeters (3/16″). Dyed knit socks showed a pronounced slub effect. Close examination of the slubs revealed the filaments in the area only of the slubs having the wing-members formed in a rising and falling wave-like manner.

EXAMPLE 2

Same as Example 1 except the feed roll temperature was 105° C. The effect was similar to that described in Example 1.

EXAMPLE 3

Same as Example 2 except that the take-up speed was 400 meters per minute. The effect was similar to that described in Example 1.

As heretofore indicated, slub yarns of the present invention provide useful and desirable novelty effects in home furnishing and apparel fabrics.

The invention has been described in detail with particular reference to preferred embodiments thereof, but it will be understood that variations and modifications can be effected within the spirit and scope of the invention.

I claim:

1. Continuous filament yarn of textile utility wherein said yarn has slubs formed at randomly spaced intervals along the length of the yarn, and wherein each filament has a main body section extending along the length of the filament and at least one wing member extending from said main body section along the length of the filament, said wing member rising and falling in wave-like manner along said main body section only within the area of said randomly spaced intervals.

2. Continuous filament yarn as defined in claim 1 wherein the length of the wave-like wing member within the area of said randomly spaced interval varies from about 0.635 centimeter (0.25 inch) to about 15.2 centimeters (6 inches).

3. Continuous filament slub yarn as defined in claim 2 wherein the intervals between slubs vary in a random manner with the mean interval being about 30.5 centimeters (12 inches) to about 91.4 centimeters (36 inches), the standard deviation of the interval distances varying from about $\frac{1}{4}$ the mean interval distance to about $1\frac{1}{4}$ times the mean interval distance.

* * * * *